US005275004A

United States Patent [19]

Agrawal et al.

[11] Patent Number: 5,275,004

[45] Date of Patent: Jan. 4, 1994

[54] CONSOLIDATED HEAT EXCHANGER AIR SEPARATION PROCESS

[75] Inventors: Rakesh Agrawal, Emmaus; William T. Kleinberg, Breinigsville, both of Pa.

[73] Assignee: Air Products and Chemicals, Inc., Allentown, Pa.

[21] Appl. No.: 918,477

[22] Filed: Jul. 21, 1992

[51] Int. Cl.[5] ..... F25J 3/02

[52] U.S. Cl. ..... 62/24; 62/41

[58] Field of Search ..... 62/24, 41

[56] References Cited

U.S. PATENT DOCUMENTS

| | | | |
|---|---|---|---|
| 4,345,925 | 8/1982 | Cheung | 62/41 |
| 4,747,859 | 5/1988 | Gladman et al. | 62/24 |
| 5,036,672 | 8/1991 | Rottmann | 62/24 |
| 5,152,149 | 10/1992 | Mostello et al. | 62/41 |

*Primary Examiner*—Ronald C. Capossela

*Attorney, Agent, or Firm*—Robert J. Wolff; James C. Simmons; William F. Marsh

[57] ABSTRACT

The present invention relates to the heat exchanger system in a process for the cryogenic distillation of air. In particular, the present invention is an improvement to the heat exchanger system to increase the operational efficiency of the process.

5 Claims, 3 Drawing Sheets

CONSOLIDATED HEAT EXCHANGER AIR SEPARATION PROCESS

FIELD OF THE INVENTION

The present invention relates to the heat exchanger system in a process for the cryogenic distillation of air.

BACKGROUND OF THE INVENTION

Processes which separate air via cryogenic distillation require a heat exchanger system in order to make the process workable and/or to achieve a power savings. The conventional heat exchanger system employs separate heat exchangers for each type of heat exchange service. For example, the heat exchanger system will at the very least include (1) a main or primary heat exchanger for cooling the feed air to a temperature near its dew point against other warming process streams and (2) a reboiler/condenser for condensing a nitrogen-rich gaseous overhead stream against a vaporizing oxygen-enriched liquid bottoms stream. The heat exchanger system will often further comprise a subcooler for subcooling a liquid process stream to a temperature lower than its bubble point.

The problems with the conventional heat exchanger system include the high cost of purchasing separate heat exchangers as well as the pressure drop and costs associated with the piping connecting the heat exchangers. It is an object of the present invention to minimize these problems associated with the conventional heat exchanger system.

SUMMARY OF THE INVENTION

The present invention is an improvement to a process for the cryogenic distillation of air. In the process to which the improvement pertains, a feed air is compressed, cooled to near its dew point in a primary heat exchanger against other warming process streams and fed to a distillation column system having at least one distillation column. Also in the process to which the improvement pertains, a second heat exchange is performed in a reboiler/condenser between at least a portion of a nitrogen-rich gaseous overhead stream and at least a portion of an oxygen-enriched liquid bottoms stream whereby the nitrogen-rich gaseous overhead stream is condensed in the reboiler/condenser and the oxygen-enriched liquid bottoms stream is vaporized in the reboiler/condenser. The improvement is for increasing the operational efficiency of the process and comprises performing the reboiler/condenser's heat exchange service in the primary heat exchanger.

Where the process further comprises subcooling a liquid process stream in a subcooler, the improvement can further comprise performing the subcooler's heat exchange service in the primary heat exchanger as well. Alternatively where the process further comprises a subcooler, the improvement can instead comprise performing the reboiler/condenser's heat exchange service in the primary heat exchanger and/or the subcooler.

DETAILED DESCRIPTION OF THE INVENTION

To better understand the present invention, it is important to understand the prior art with respect to the heat exchanger system in a process for the cryogenic distillation of air. The conventional heat exchanger system employs separate heat exchangers for each type of heat exchange service. For example, the heat exchanger system will at the very least include (1) a main or primary heat exchanger for cooling the feed air to a temperature near its dew point against other warming process streams and (2) a reboiler/condenser for condensing a nitrogen-rich gaseous overhead stream against a vaporizing oxygen-enriched liquid bottoms stream. At least a portion of the condensed overhead stream is typically returned to the distillation column system as a reflux stream. The heat exchanger system will often further comprise a subcooler for subcooling a liquid process stream to a temperature lower than its bubble point.

The problems with the conventional heat exchanger system include the high cost of purchasing separate heat exchangers as well as the pressure drop and costs associated with the piping connecting the heat exchangers. The present invention minimizes these problems by performing the reboiler/condenser's heat exchange service in the primary heat exchanger. Where a subcooler is present, the improvement can further comprise performing the subcooler's heat exchange service in the primary heat exchanger. Alternatively in the situation where a subcooler is present, the improvement can instead comprise performing the reboiler/condenser's heat exchange service in the primary heat exchanger and/or the subcooler.

Figure 1:
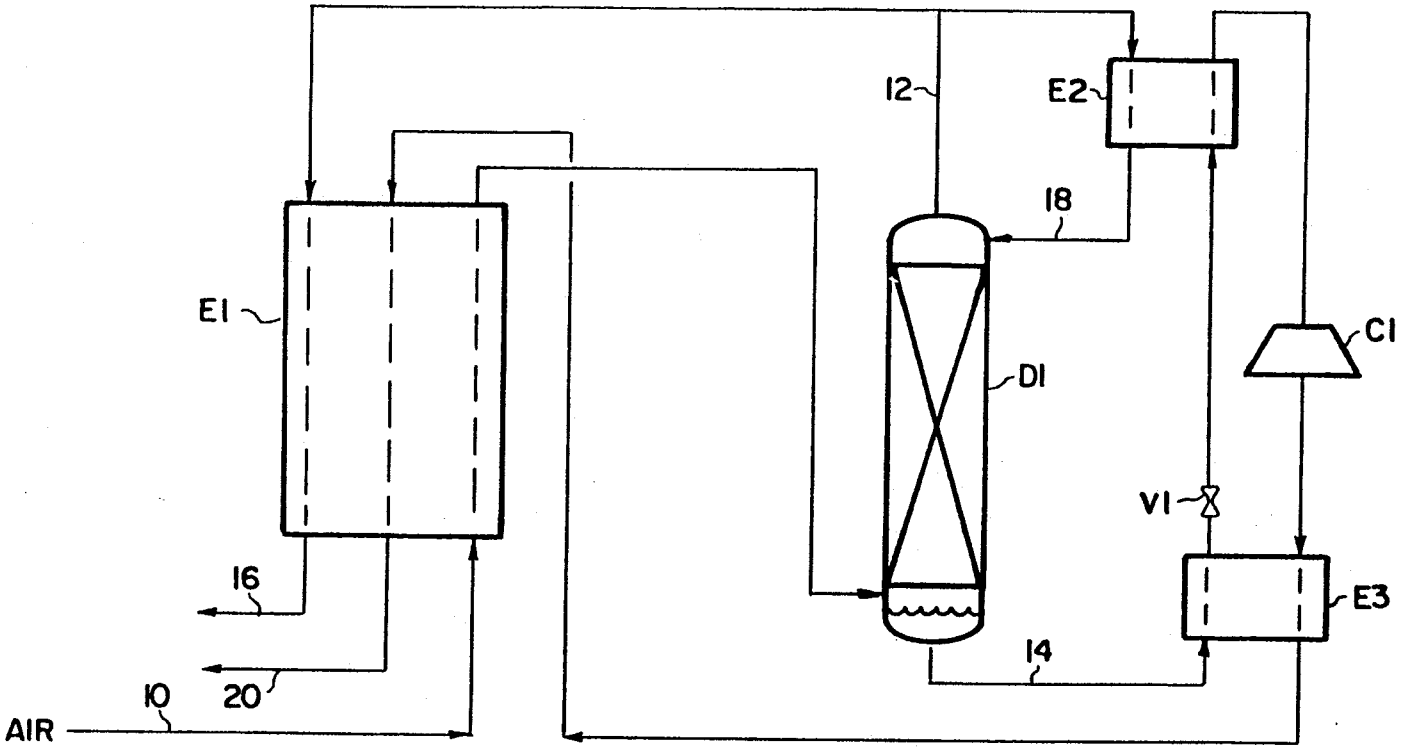
FIG. 1 PRIOR ART
FIG. 1 is a process flowsheet illustrating an air separation process which incorporates the conventional heat exchanger system.

FIG. 1 is representative of an air separation process which incorporates the conventional heat exchanger system. As shown in FIG. 1, separate heat exchangers E1, E2, and E3 are used for the primary heat exchanger, the reboiler/condenser and the subcooler respectively. Referring now to FIG. 1, a compressed feed air 10 which has been cleaned of impurities which will freeze out at cryogenic temperatures is cooled to near its dew-point in primary heat exchanger E1 against other warming process streams. The resultant stream is fed to distillation column D1 in which the compressed, cooled feed air is rectified into a nitrogen-rich gaseous overhead stream 12 and an oxygen-enriched liquid bottoms stream 14. A portion of stream 12 is warmed in heat exchanger E1 and subsequently removed as a nitrogen-rich gaseous product in stream 16. The remaining portion of stream 12 is condensed in reboiler/condenser E2 and subsequently returned to the distillation column as reflux in stream 18. Stream 14 is subcooled in subcooler E3, reduced in pressure across valve V1, vaporized in reboiler/condenser E2, expanded in expander C1 to provide refrigeration for the process, warmed in subcooler E3, further warmed in primary heat exchanger E1 and subsequently removed as an oxygen-enriched gaseous product in stream 20.

Figure 2:
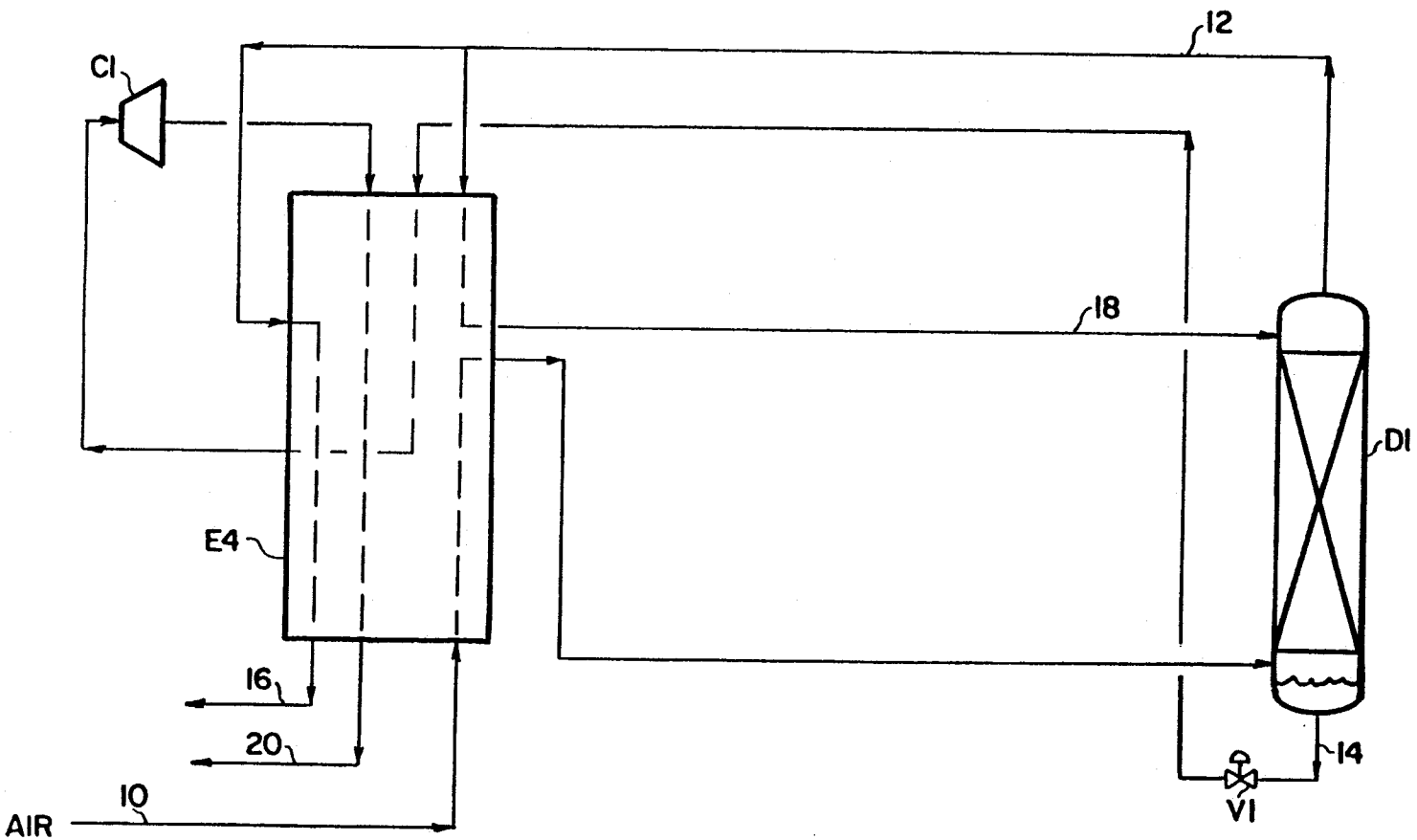
FIG. 2 is a process flowsheet illustrating a first embodiment of the present invention.

FIG. 2 is a first embodiment of the present invention as applied to the flowsheet depicted in FIG. 1. Similar streams and equipment in FIG. 2 utilize common numbering with FIG. 1. Comparing FIG. 2 to FIG. 1, it can be seen that FIG. 1's reboiler/condenser E2 and subcooler E3 have been consolidated into FIG. 2's primary heat exchanger E4.

Figure 3:
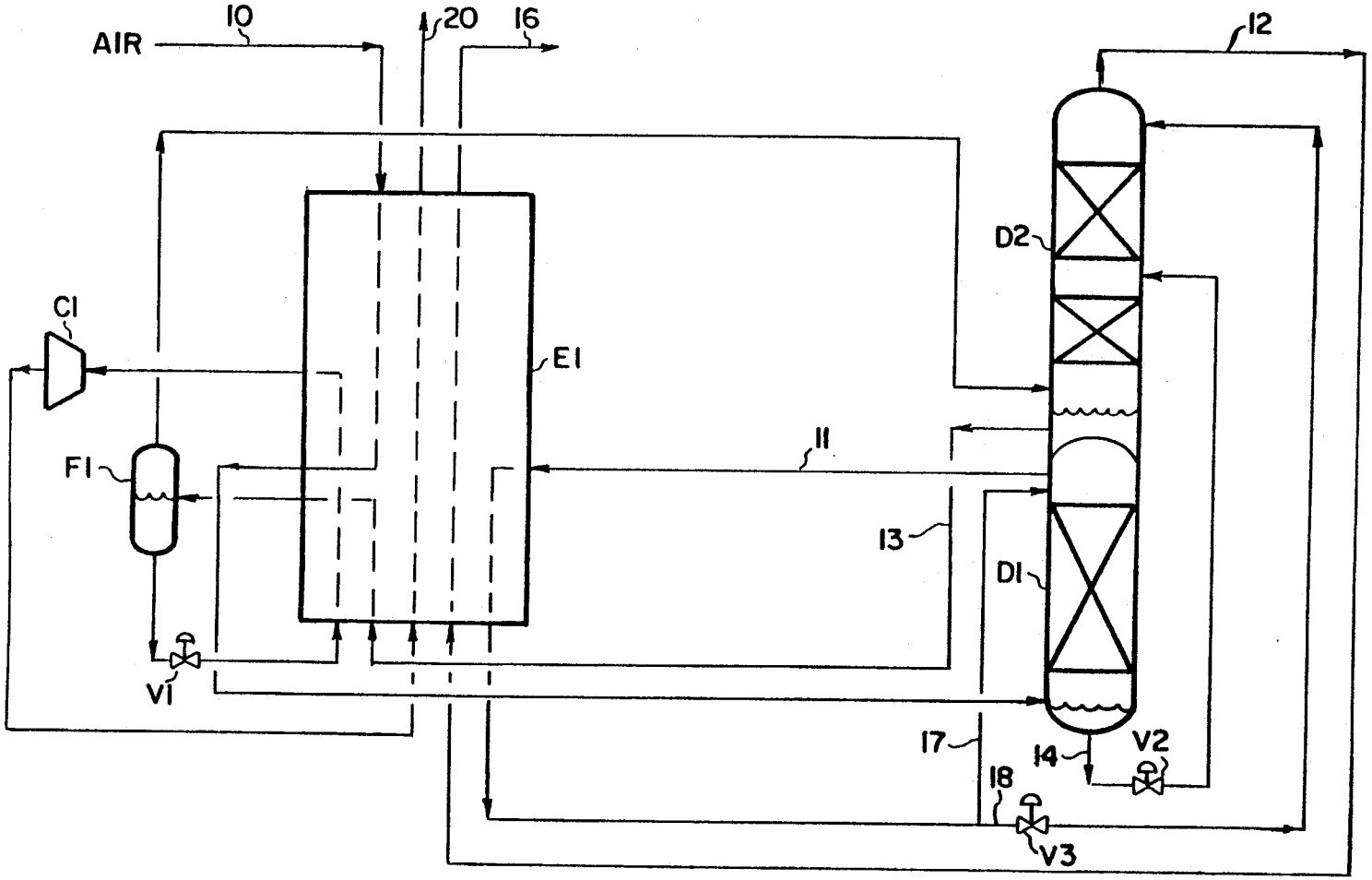
FIG. 3 is a process flowsheet illustrating a second embodiment of the present invention.

FIG. 3 is a second embodiment of the present invention as applied to the conventional dual distillation column system comprising a high pressure column and a low pressure column. Referring now to FIG. 3, a compressed feed air 10 which has been cleaned of impurities which will freeze out at cryogenic temperatures is cooled to near its dewpoint in primary heat exchanger E1 against other warming process streams. The resultant stream is fed to high pressure column D1 in which the compressed, cooled feed air is rectified into a nitrogen-rich gaseous overhead stream 1 and a crude liquid oxygen bottoms stream 14. Stream 14 is reduced in pressure across valve V2 and subsequently fed to low pressure column D2 in which stream 14 is distilled into a high purity nitrogen overhead stream 12 and an oxygen-enriched liquid bottoms stream 13. Stream 12 is warmed in the primary heat exchanger and subsequently removed as a high purity gaseous nitrogen product in stream 16. Stream 11 is condensed in the primary heat exchanger and subsequently split into streams 17 and 18. Stream 17 is used as reflux for the high pressure column while stream 18 is reduced in pressure across valve V3 and subsequently used a reflux for the low pressure column. Stream 13 is partially vaporized in the primary heat exchanger and flashed in flash drum F1. The vapor resulting from the flash is returned to the low pressure column as feed while the liquid resulting from the flash is reduced in pressure across valve V1, vaporized and partially warmed in the primary heat exchanger, expanded in expander C1 to provide refrigeration for the process, further warmed in the primary heat exchanger E1 and subsequently removed as an oxygen-enriched gaseous product in stream 20.

The present invention provides a capital cost savings for air separation plants due to a reduction in the number of heat exchangers and interconnecting piping. A power savings is also achieved by the reduction of pressure drop associated with the interconnecting piping.

The present invention has been described with reference to two specific embodiments thereof. These embodiments should not be viewed as limitation to the present invention, the scope of which should be ascertained by the following claims.

I claim:

1. In a process for the cryogenic distillation of air wherein:

(a) a feed air is cooled to near its dew point by a first heat exchange in a primary heat exchanger against other warming process streams and fed to a distillation column system having at least one distillation column;

(b) a second heat exchange is performed in a reboiler/condenser between at least a portion of a nitrogen-rich gaseous overhead stream and at least a portion of an oxygen-enriched liquid bottoms stream whereby the nitrogen-rich gaseous overhead stream is condensed in the reboiler/condenser and the oxygen-enriched liquid bottoms stream is vaporized in the reboiler/condenser:

the improvement for increasing the operational efficiency of the process by consolidating the first and second heat exchanges comprising performing the second heat exchange in the primary heat exchanger.

2. The process of claim 1 wherein a liquid process stream is subcooled by a third heat exchange in a subcooler and wherein said improvement further comprises performing the third heat exchange in the primary heat exchanger.

3. The process of claim 2 wherein:

(a) the distillation column system comprises a single distillation column in which the compressed, cooled feed air is rectified into the nitrogen-rich gaseous overhead stream and the oxygen-enriched liquid bottoms stream;

(b) subsequent to the second heat exchange, at least a portion of the condensed overhead stream is fed to the distillation column as reflux while at least a portion of the vaporized bottoms stream is removed as a product stream.

4. The process of claim 2 wherein:

(a) the distillation column system comprises a high pressure column and a low pressure column;

(b) at least a portion of the compressed, cooled feed air is fed to the high pressure column in which the compressed, cooled feed air is rectified into the nitrogen-rich gaseous overhead stream and a crude liquid oxygen bottoms: and (c) at least a portion of the crude liquid oxygen bottoms is fed to the low pressure column in which the crude liquid oxygen bottoms is distilled into a high purity nitrogen overhead and the oxygen-enriched liquid bottoms stream.

(d) subsequent to the second heat exchange, at least a portion of the condensed overhead stream is returned to the distillation column system as reflux while at least a portion of the vaporized bottoms stream is returned to the distillation column system as a secondary feed stream.

5. The process of claim 1 wherein a liquid process stream is subcooled by a third heat exchange in a subcooler and wherein said improvement for increasing the operational efficiency of the process comprises performing the second heat exchange in the primary heat exchanger and/or the subcooler.

* * * * *